US010473330B2

(12) United States Patent
Max et al.

(10) Patent No.: US 10,473,330 B2
(45) Date of Patent: Nov. 12, 2019

(54) SWEPT COMBUSTOR LINER PANELS FOR GAS TURBINE ENGINE COMBUSTOR

(71) Applicant: United Technologies Corporation, Farmington, CT (US)

(72) Inventors: Seth A. Max, Manchester, CT (US); Kevin J. Low, Portland, CT (US)

(73) Assignee: United Technologies Corporation, Farmington, CT (US)

( * ) Notice: Subject to any disclaimer, the term of this patent is extended or adjusted under 35 U.S.C. 154(b) by 482 days.

(21) Appl. No.: 15/031,070

(22) PCT Filed: Nov. 18, 2014

(86) PCT No.: PCT/US2014/066167

§ 371 (c)(1),
(2) Date: Apr. 21, 2016

(87) PCT Pub. No.: WO2015/074052

PCT Pub. Date: May 21, 2015

(65) Prior Publication Data

US 2016/0265771 A1 Sep. 15, 2016

Related U.S. Application Data

(60) Provisional application No. 61/905,572, filed on Nov. 18, 2013.

(51) Int. Cl.

| | |
|---|---|
| ***F23R 3/04*** | (2006.01) |
| ***F23R 3/06*** | (2006.01) |
| ***F23R 3/10*** | (2006.01) |
| ***F23R 3/00*** | (2006.01) |
| ***F23R 3/58*** | (2006.01) |

(52) U.S. Cl.
CPC ..... *F23R 3/002* (2013.01); *F23R 3/58* (2013.01); *F23R 3/06* (2013.01)

(58) Field of Classification Search
CPC .... F23R 3/002; F23R 3/04; F23R 3/06; F23R 3/10; F23R 3/58
See application file for complete search history.

(56) References Cited

U.S. PATENT DOCUMENTS

| | | | | |
|---|---|---|---|---|
| 6,408,628 | B1 * | 6/2002 | Pidcock | F23R 3/002 60/752 |
| 2002/0178728 | A1 | 12/2002 | McCaffrey et al. | |
| 2002/0184762 | A1 | 12/2002 | Farmer et al. | |
| 2002/0184763 | A1 | 12/2002 | Emilianowicz | |
| 2003/0213250 | A1 | 11/2003 | Pacheco-Tougas et al. | |

(Continued)

OTHER PUBLICATIONS

Extended EP Search Report dated Nov. 17, 2016.
EP Office Action for EP Appln. No. 14862049.5 dated Mar. 7, 2018.

*Primary Examiner* — William H Rodriguez
*Assistant Examiner* — Alyson Joan Harrington
(74) *Attorney, Agent, or Firm* — O'Shea Getz P.C.

(57) ABSTRACT

A liner panel is provided for use in a combustor of a gas turbine engine. The liner panel includes a first liner panel side edge between a liner panel aft edge and a liner panel forward edge. The liner panel also includes a second liner panel side edge between the liner panel aft edge and the liner panel forward edge. The first and the second liner panel side edges are non-perpendicular to the liner panel forward and aft edge edges.

8 Claims, 8 Drawing Sheets

(56) References Cited

U.S. PATENT DOCUMENTS

| | | | | |
|---|---|---|---|---|
| 2004/0107575 | A1 | 6/2004 | Emilianowicz | |
| 2004/0168786 | A1 | 9/2004 | Isano et al. | |
| 2006/0130485 | A1 | 6/2006 | Danis et al. | |
| 2009/0094985 | A1 | 4/2009 | Johnson et al. | |
| 2010/0095679 | A1 | 4/2010 | Rudrapatna et al. | |
| 2010/0162716 | A1 | 7/2010 | Bastnagel et al. | |
| 2010/0242483 | A1 | 9/2010 | Snyder et al. | |
| 2011/0048024 | A1 | 3/2011 | Snyder et al. | |
| 2012/0279226 | A1* | 11/2012 | Chen | F01D 9/023 60/772 |
| 2012/0304656 | A1 | 12/2012 | Melton et al. | |
| 2012/0324894 | A1 | 12/2012 | Dierberger | |
| 2013/0019603 | A1 | 1/2013 | Dierberger et al. | |
| 2013/0025287 | A1 | 1/2013 | Cunha | |
| 2013/0025288 | A1 | 1/2013 | Cunha et al. | |
| 2013/0055722 | A1 | 3/2013 | Verhiel et al. | |
| 2013/0081398 | A1 | 4/2013 | Kramer | |
| 2013/0232978 | A1 | 9/2013 | Dai et al. | |

* cited by examiner

SWEPT COMBUSTOR LINER PANELS FOR GAS TURBINE ENGINE COMBUSTOR

CROSS-REFERENCE TO RELATED APPLICATION

This application claims priority to PCT Patent Application No. PCT/US14/66167 filed Nov. 18, 2014, which claims priority to U.S. Provisional Application Ser. No. 61/905,572 filed Nov. 18, 2013, which are hereby incorporated herein by reference in their entireties.

BACKGROUND

The present disclosure relates to a gas turbine engine and, more particularly, to a combustor section therefor.

Gas turbine engines, such as those that power modern commercial and military aircraft, generally include a compressor section to pressurize an airflow, a combustor section to burn a hydrocarbon fuel in the presence of the pressurized air, and a turbine section to extract energy from the resultant combustion gases.

The combustor section typically includes an outer shell lined with heat shields often referred to as liner panels which are attached to the outer shell. Although effective, the rectilinear liner panels form axially arranged gaps therebetween when assembled to the shell. The axial gaps may provide hot streak injection along an entire length of the gap that may cause localized shell burn back.

SUMMARY

A liner panel for use in a combustor of a gas turbine engine, the liner panel according to one disclosed non-limiting embodiment of the present disclosure includes a first liner panel side edge between a liner panel aft edge and a liner panel forward edge. A second liner panel side edge is between the liner panel aft edge and the liner panel forward edge. The first and second liner panel side edges are non-perpendicular to the liner panel forward and aft edge edges.

In a further embodiment of the present disclosure, the first liner panel side edge, the second liner panel side edge, the liner panel forward edge and the liner panel aft edge generally define a parallelogram.

In a further embodiment of any of the foregoing embodiments of the present disclosure, a multiple of studs are included which extend from the liner panel.

A wall assembly for use in a combustor of a gas turbine engine, the wall assembly according to another disclosed non-limiting embodiment of the present disclosure includes a support shell arranged around an engine central longitudinal axis. A multiple of liner panels are mounted to the support shell. The multiple of liner panels define a multiple of liner panel gaps around the engine central longitudinal axis with at least one of the multiple of liner panel gaps swept with respect to the axis.

In a further embodiment of any of the foregoing embodiments of the present disclosure, each of the multiple of liner panel gaps are swept with respect to the engine central longitudinal axis.

In a further embodiment of any of the foregoing embodiments of the present disclosure, each of the multiple of liner panel gaps are swept about 10-45 degrees with respect to the engine central longitudinal axis.

In a further embodiment of any of the foregoing embodiments of the present disclosure, each of the multiple of liner panel gaps are swept about 20 degrees with respect to the engine central longitudinal axis.

In a further embodiment of any of the foregoing embodiments of the present disclosure, each the multiple of liner panels defines a parallelogram.

In a further embodiment of any of the foregoing embodiments of the present disclosure, the multiple of liner panels are outboard of the support shell with respect to the engine central longitudinal axis.

In a further embodiment of any of the foregoing embodiments of the present disclosure, the multiple of liner panels are inboard of the support shell with respect to the engine central longitudinal axis.

In a further embodiment of any of the foregoing embodiments of the present disclosure, the first liner panel side edge and the second liner panel side edge are parallel.

In a further embodiment of any of the foregoing embodiments of the present disclosure, the liner panel forward edge and the liner panel aft edge are parallel.

A combustor of a gas turbine engine, the combustor according to another disclosed non-limiting embodiment of the present disclosure includes a multiple of first liner panels mounted to a first support shell around an engine central longitudinal axis. The multiple of first liner panels define a multiple of first liner panel gaps around the engine central longitudinal axis. The multiple of first liner panel gaps are swept with respect to the axis.

In a further embodiment of any of the foregoing embodiments of the present disclosure, the multiple of first liner panel gaps include a multiple of outer liner panel gaps and a multiple of inner liner panel gaps. The outer liner panel gaps swept in a direction opposite that of the multiple of inner liner panel gaps.

In a further embodiment of any of the foregoing embodiments of the present disclosure, the multiple of outer liner panel gaps and the multiple of inner liner panel gaps are swept with to a swirler flow direction.

In a further embodiment of any of the foregoing embodiments of the present disclosure, the multiple of outer liner panel gaps and the multiple of inner liner panel gaps are swept transverse to a swirler flow direction.

In a further embodiment of any of the foregoing embodiments of the present disclosure, the swirler flow direction is generally transverse to the multiple of first liner panel gaps.

In a further embodiment of any of the foregoing embodiments of the present disclosure, each of the multiple of first liner panels define a parallelogram.

In a further embodiment of any of the foregoing embodiments of the present disclosure, the multiple of first liner panel gaps include a multiple of outer liner panel gaps and a multiple of inner liner panel gaps. The outer liner panel gaps are swept in a direction of the multiple of inner liner panel gaps.

A combustor of a gas turbine engine, the combustor according to another disclosed non-limiting embodiment of the present disclosure includes a multiple of first liner panels mounted to a first support shell around an engine central longitudinal axis. The multiple of first liner panels define a multiple of first liner panel gaps around the engine central longitudinal axis. The multiple of first liner panel gaps are swept with respect to a swirler flow direction.

In a further embodiment of any of the foregoing embodiments of the present disclosure, the multiple of first liner panel gaps include a multiple of outer liner panel gaps and a multiple of inner liner panel gaps. The outer liner panel gaps are swept in a direction opposite that of the multiple of inner liner panel gaps. The multiple of outer liner panel gaps and the multiple of inner liner panel gaps are swept with respect to a swirler flow direction.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment(s). The drawings that accompany the detailed description can be briefly described as follows.

DETAILED DESCRIPTION

Figure 1:
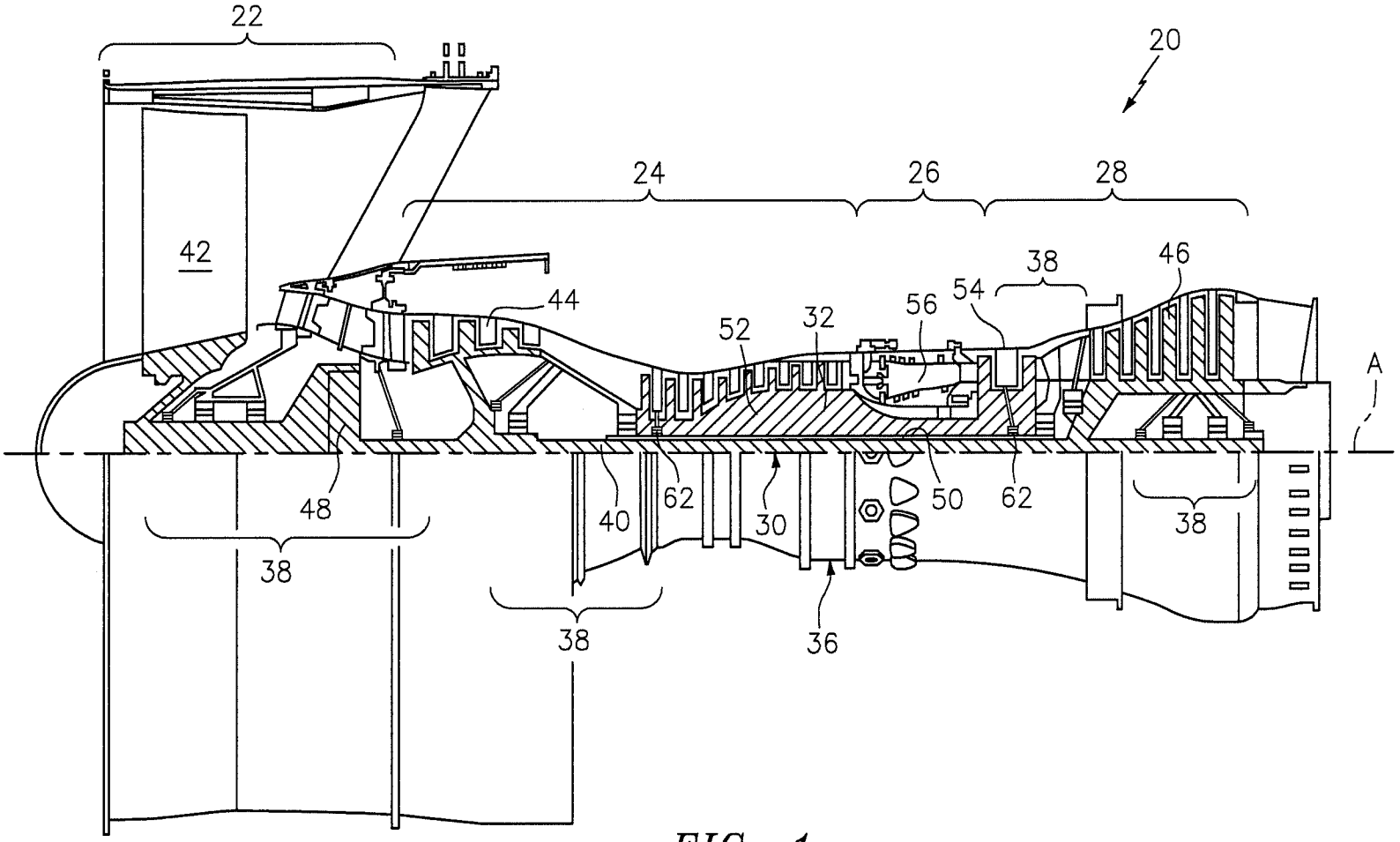
FIG. 1 is a schematic cross-section of an example gas turbine engine architecture.
Figure 2:
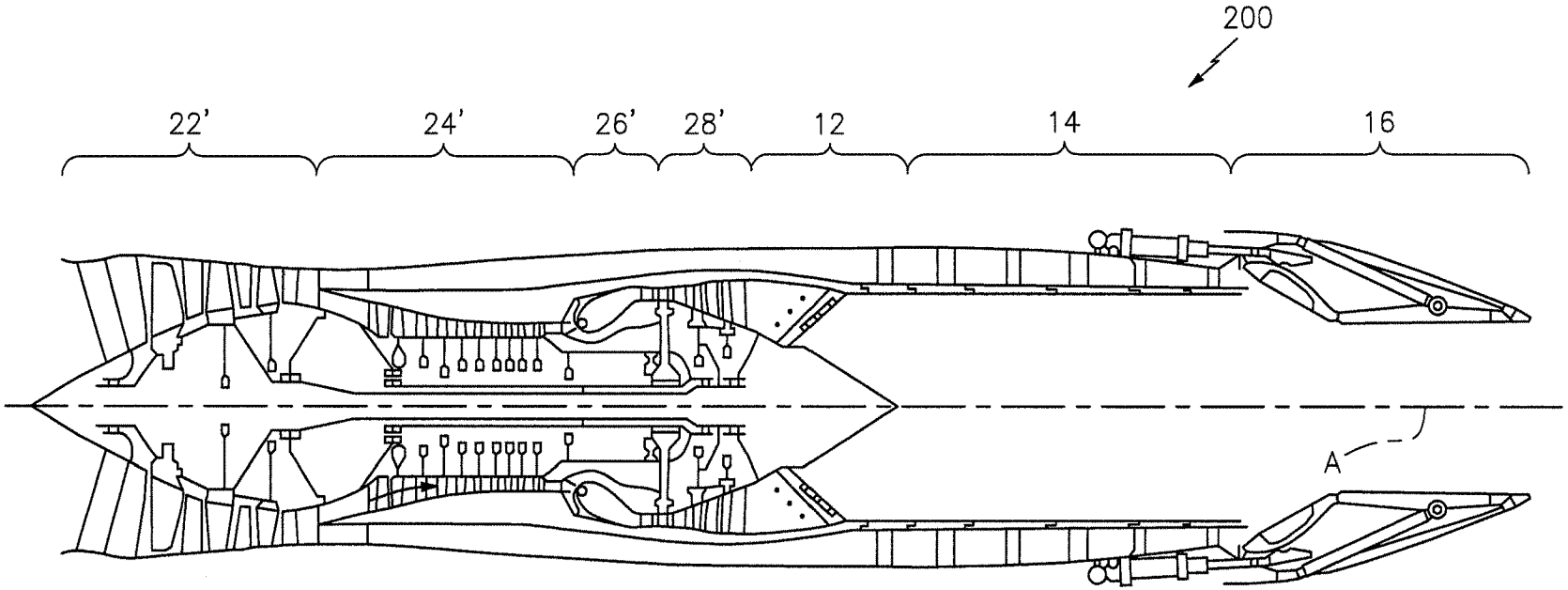
FIG. 2 is a schematic cross-section of another example gas turbine engine architecture.

FIG. 1 schematically illustrates a gas turbine engine 20. The gas turbine engine 20 is disclosed herein as a two-spool turbo fan that generally incorporates a fan section 22, a compressor section 24, a combustor section 26 and a turbine section 28. Alternative engine architectures 200 might include an augmentor section 12, an exhaust duct section 14 and a nozzle section 16 in addition to the fan section 22', compressor section 24', combustor section 26' and turbine section 28' (see FIG. 2) among other systems or features. The fan section 22 drives air along a bypass flowpath and into the compressor section 24. The compressor section 24 drives air along a core flowpath for compression and communication into the combustor section 26, which then expands and directs the air through the turbine section 28. Although depicted as a turbofan in the disclosed non-limiting embodiment, it should be understood that the concepts described herein are not limited to use with turbofans as the teachings may be applied to other types of turbine engines such as a turbojets, turboshafts, and three-spool (plus fan) turbofans with an intermediate spool.

The engine 20 generally includes a low spool 30 and a high spool 32 mounted for rotation about an engine central longitudinal axis A relative to an engine static structure 36 via several bearing structures 38. The low spool 30 generally includes an inner shaft 40 that interconnects a fan 42, a low pressure compressor ("LPC") 44 and a low pressure turbine ("LPT") 46. The inner shaft 40 drives the fan 42 directly or through a geared architecture 48 to drive the fan 42 at a lower speed than the low spool 30. An exemplary reduction transmission is an epicyclic transmission, namely a planetary or star gear system.

The high spool 32 includes an outer shaft 50 that interconnects a high pressure compressor ("HPC") 52 and high pressure turbine ("HPT") 54. A combustor 56 is arranged between the HPC 52 and the HPT 54. The inner shaft 40 and the outer shaft 50 are concentric and rotate about the engine central longitudinal axis A which is collinear with their longitudinal axes.

Core airflow is compressed by the LPC 44 then the HPC 52, mixed with the fuel and burned in the combustor 56, then expanded over the HPT 54 and the LPT 46. The LPT 46 and HPT 54 rotationally drive the respective low spool 30 and high spool 32 in response to the expansion. The main engine shafts 40, 50 are supported at a plurality of points by the bearing structures 38 within the static structure 36. It should be understood that various bearing structures 38 at various locations may alternatively or additionally be provided.

Figure 3:
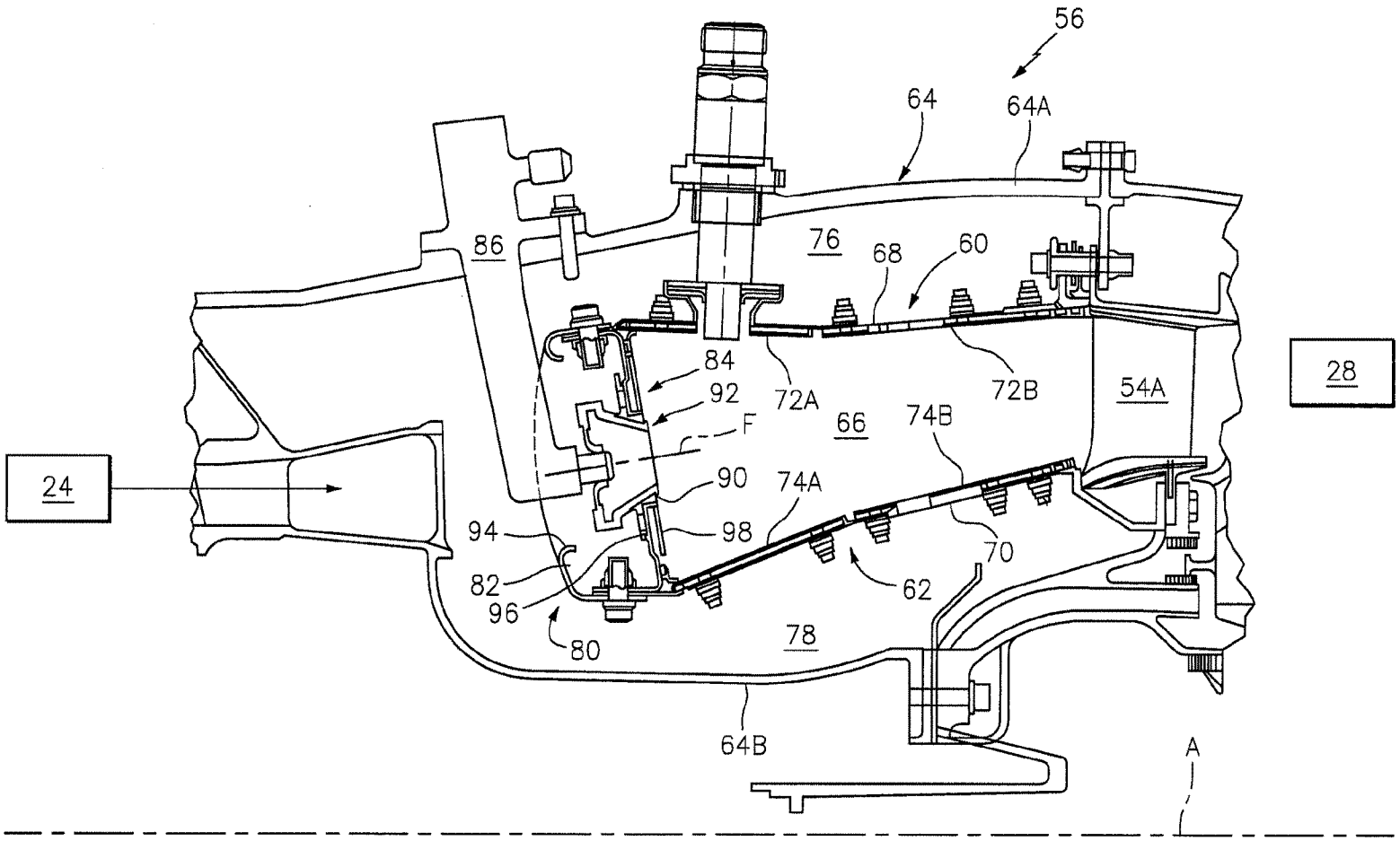
FIG. 3 is an expanded longitudinal schematic sectional view of a combustor section according to one non-limiting embodiment that may be used with the example gas turbine engine architectures shown in FIGS. 1 and 2.

With reference to FIG. 3, the combustor section 26 generally includes a combustor 56 with an outer combustor wall assembly 60, an inner combustor wall assembly 62 and a diffuser case module 64 therearound. The outer combustor wall assembly 60 and the inner combustor wall assembly 62 are spaced apart such that an annular combustion chamber 66 is defined therebetween.

The outer combustor wall assembly 60 is spaced radially inward from an outer diffuser case 64A of the diffuser case module 64 to define an outer annular plenum 76. The inner combustor wall assembly 62 is spaced radially outward from an inner diffuser case 64B of the diffuser case module 64 to define an inner annular plenum 78. It should be understood that although a particular combustor is illustrated, other combustor types with various combustor liner arrangements will also benefit herefrom. It should be further understood that the disclosed cooling flow paths are but an illustrated embodiment and should not be limited only thereto.

The combustor wall assemblies 60, 62 contain the combustion products for direction toward the turbine section 28. Each combustor wall assembly 60, 62 generally includes a respective support shell 68, 70 which supports one or more liner panels 72, 74 mounted thereto. Each of the liner panels 72, 74 may be generally rectilinear and manufactured of, for example, a nickel based super alloy, ceramic or other temperature resistant material and are arranged to form a liner array. In the example liner array, a multiple of forward liner panels 72A and a multiple of aft liner panels 72B line the outer shell 68. A multiple of forward liner panels 74A and a multiple of aft liner panels 74B also line the inner shell 70. It should be appreciated that the liner array may alternatively include but a single panel rather than the illustrated axial forward and axial aft panels.

The combustor 56 further includes a forward assembly 80 immediately downstream of the compressor section 24 to receive compressed airflow therefrom. The forward assembly 80 generally includes an annular hood 82, a bulkhead assembly 84, and a multiple of swirlers 90 (one shown). Each of the swirlers 90 is circumferentially aligned with one of a multiple of fuel nozzles 86 (one shown) and the respective hood ports 94 to project through the bulkhead assembly 84. The bulkhead assembly 84 includes a bulkhead support shell 96 secured to the combustor walls 60, 62, and a multiple of circumferentially distributed bulkhead liner panels 98 secured to the bulkhead support shell 96 around each respective swirler opening 92. The bulkhead support shell 96 is generally annular and the multiple of circumferentially distributed bulkhead liner panels 98 are segmented, typically one to each fuel nozzle 86 and swirler 90.

The annular hood 82 extends radially between, and is secured to, the forwardmost ends of the combustor wall assemblies 60, 62. The annular hood 82 includes a multiple of circumferentially distributed hood ports 94 that receive one of the respective multiple of fuel nozzles 86 and facilitates the direction of compressed air into the forward end of the combustion chamber 66 through a swirler opening 92. Each fuel nozzle 86 may be secured to the diffuser case module 64 and project through one of the hood ports 94 into the respective swirler 90.

The forward assembly 80 introduces core combustion air into the forward section of the combustion chamber 66 while the remainder enters the outer annular plenum 76 and the inner annular plenum 78. The multiple of fuel nozzles 86 and adjacent structure generate a blended fuel-air mixture that supports stable combustion in the combustion chamber 66.

Opposite the forward assembly 80, the outer and inner support shells 68, 70 are mounted adjacent to a first row of Nozzle Guide Vanes (NGVs) 54A in the HPT 54. The NGVs 54A are static engine components which direct core airflow combustion gases onto the turbine blades of the first turbine rotor in the turbine section 28 to facilitate the conversion of pressure energy into kinetic energy. The core airflow combustion gases are also accelerated by the NGVs 54A because of their convergent shape and are typically given a "spin" or a "swirl" in the direction of turbine rotor rotation. The turbine rotor blades absorb this energy to drive the turbine rotor at high speed.

Figure 4:
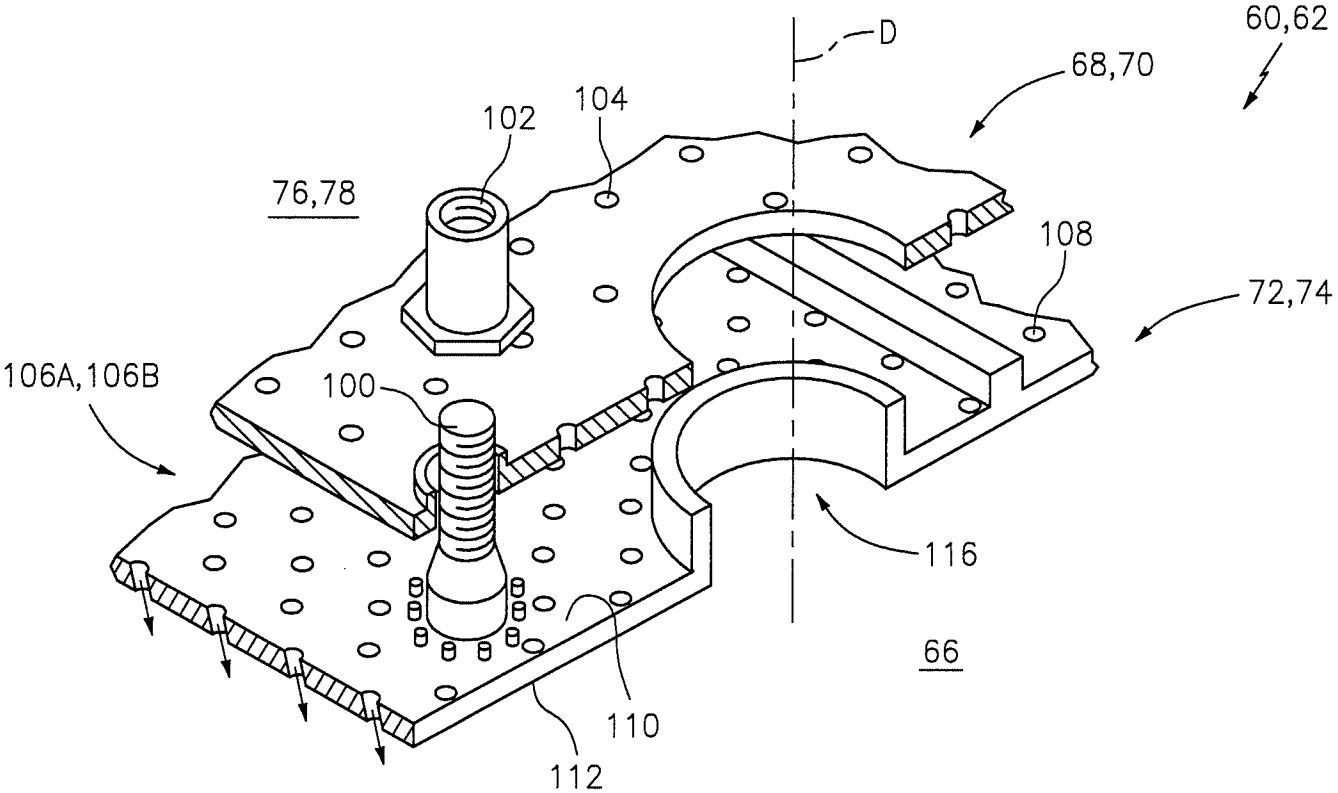
FIG. 4 is an exploded view of a wall assembly.

With reference to FIG. 4, a multiple of studs 100 (one shown) extend from the liner panels 72, 74 so as to permit the liner panels 72, 74 to be mounted to their respective support shells 68, 70 with fasteners 102 such as nuts. That is, the studs 100 project rigidly from the liner panels 72, 74 and through the respective support shells 68, 70 to receive the fasteners 102 at a threaded distal end section thereof.

A multiple of cooling impingement passages 104 penetrate through the support shells 68, 70 to allow air from the respective annular plenums 76, 78 to enter cavities 106A, 106B formed in the combustor wall assemblies 60, 62 between the respective support shells 68, 70 and liner panels 72, 74. The cooling impingement passages 104 are generally normal to the surface of the liner panels 72, 74. The air in the cavities 106A, 106B provides cold side impingement cooling of the liner panels 72, 74. As used herein, the term impingement cooling generally implies heat removal from a part via an impinging gas jet directed at a part.

A multiple of effusion passages 108 penetrate through each of the liner panels 72, 74. The geometry of the passages (e.g., diameter, shape, density, surface angle, incidence angle, etc.) as well as the location of the passages with respect to the high temperature main flow also contributes to effusion film cooling. The combination of impingement passages 104 and effusion passages 108 may be referred to as an Impingement Film Floatwall (IFF) assembly.

The effusion passages 108 allow the air to pass from the cavities 106A, 106B defined in part by a cold side 110 of the liner panels 72, 74 to a hot side 112 of the liner panels 72, 74 and thereby facilitate the formation of thin, cool, insulating blanket or film of cooling air along the hot side 112. The effusion passages 108 are generally more numerous than the impingement passages 104 to promote the development of film cooling along the hot side 112 to sheath the liner panels 72, 74. Film cooling as defined herein is the introduction of a relatively cooler air at one or more discrete locations along a surface exposed to a high temperature environment to protect that surface in the region of the air injection as well as downstream thereof.

A multiple of dilution passages 116 may each penetrate through both the respective support shells 68, 70 and liner panels 72, 74 along a respective common axis D. For example only, in a Rich-Quench-Lean (R-Q-L) type combustor, the dilution passages 116 are located downstream of the forward assembly 80 to dilute or quench the hot combustion gases within the combustion chamber 66 by direct supply of cooling air from the respective annular plenums 76, 78.

Figure 5:
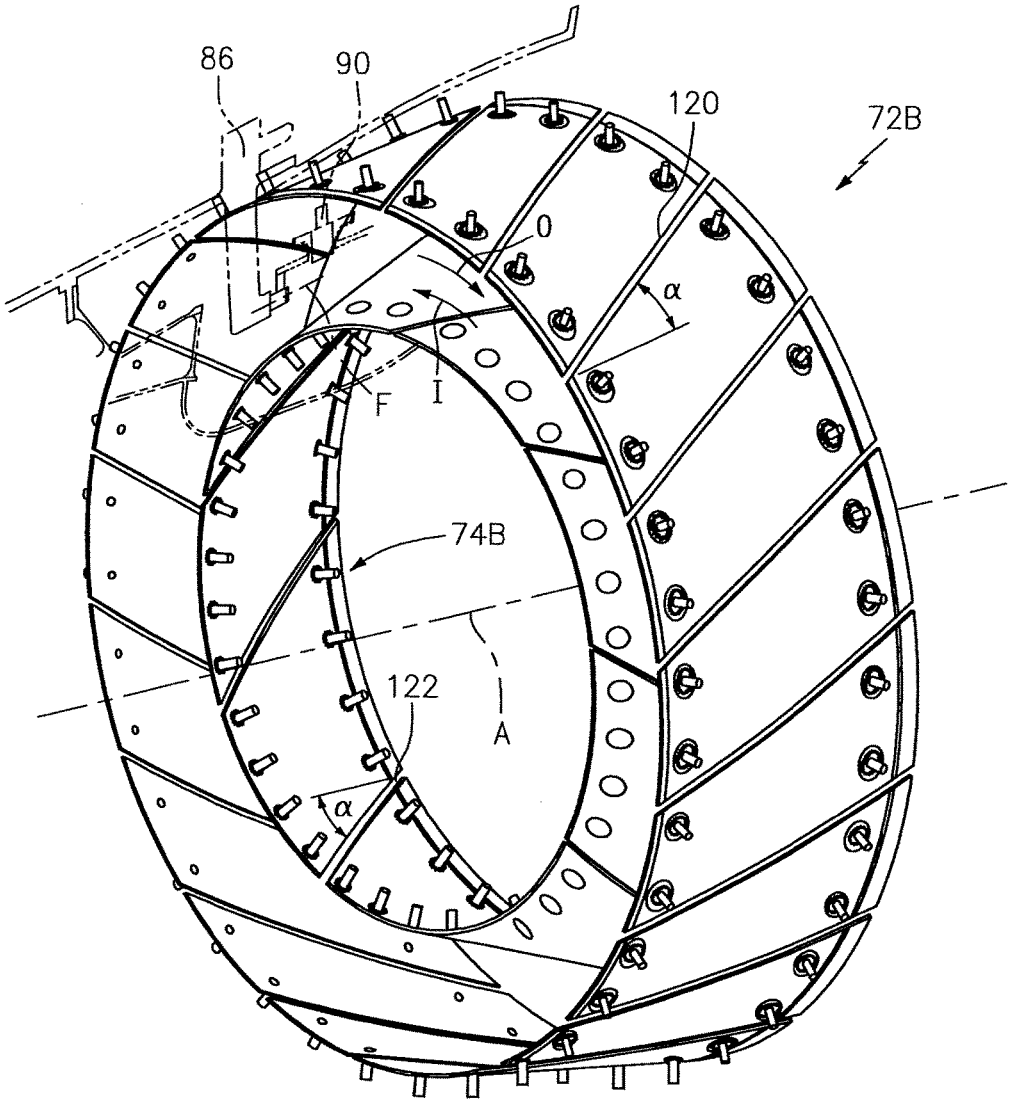
FIG. 5 is a perspective view of a combustor with swept liner panels according to one disclosed non-limiting embodiment.

With reference to FIG. 5, according to one disclosed non-limiting embodiment, the combustor wall assemblies 60, 62 (only liner panels 72B, 74B shown) define gaps 120, 122 between each pair of the respective liner panels 72, 74 to be non-parallel to the engine longitudinal axis A. That is, each gap 120, 122 is not axial, and instead is swept across a direction of flow from the upstream swirlers 90. The swept liner panel array thereby may prevent a potential hot streak from the upstream fuel nozzle 86 (one shown schematically) along the length of the gap 120, 122 or panel. The degree of sweep may, for example, be an angle $\alpha$ between about ten (10) to forty-five (45) degrees and in particular of about twenty (20) degrees with respect to the engine longitudinal axis A. It should be appreciated that various sweep angles will benefit herefrom.

Figure 6:
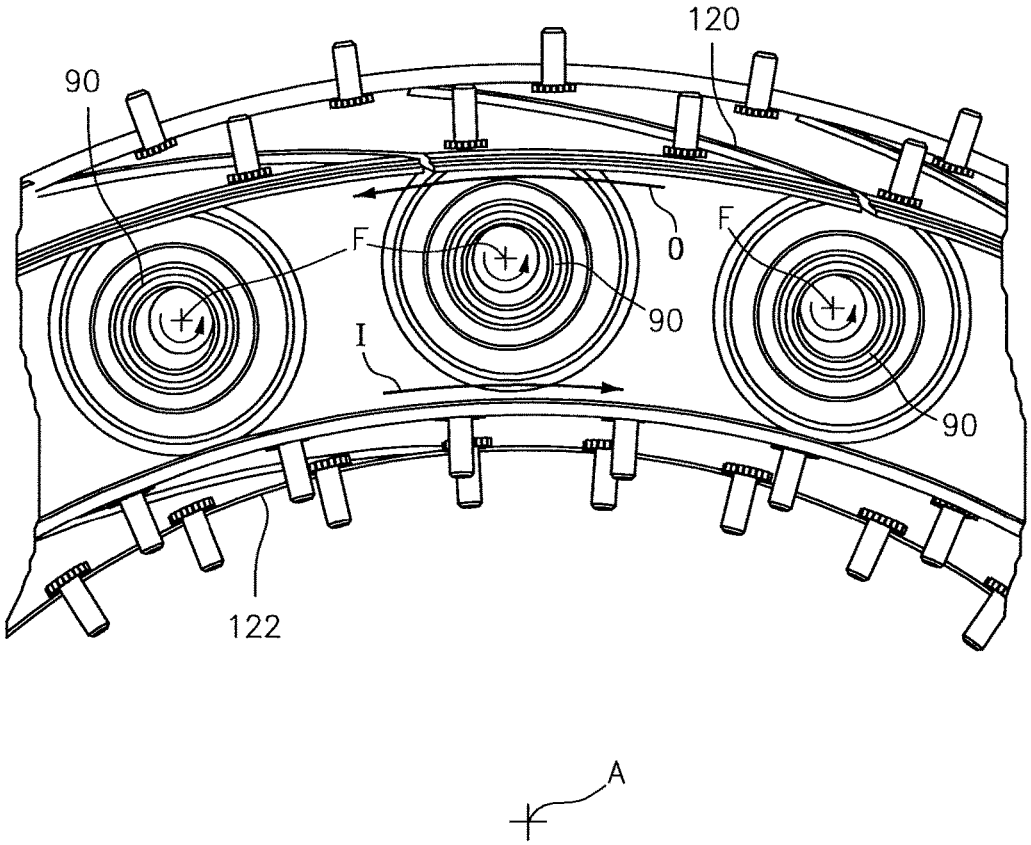
FIG. 6 is an aft to forward view of the combustor shown in FIG. 5.

In certain embodiments, the gaps 120, 122 between the adjacent respective liner panels 72, 74 are swept in particular directions relative to a rotational direction of flow from the upstream swirlers 90. In one disclosed non-limiting embodiment, the gaps 120 between the respective outer liner panels 72 are swept in a direction opposite the gaps 122 between the respective inner liner panels 74. The gaps 120 between the respective liner panels 72 are thereby against the outer peripheral flow (illustrated schematically by arrow O in FIG. 6) while the gaps 122 between the respective inner liner panels 74 are against the inner peripheral flow (illustrated schematically by arrow I in FIG. 6). The outer peripheral flow O and the inner peripheral flow I as defined herein is the outermost and innermost flow adjacent to the respective outer and inner liner panels 72, 74 generally formed by the combined flow from the multiple of upstream swirlers 90. That is, for a multiple of swirlers 90, each of which provides an example of counterclockwise flow, the outer peripheral flow adjacent to the respective outer liner panels 72 is generally counterclockwise while the inner peripheral flow adjacent to the respective inner liner panels 74 is generally clockwise. Such resultant peripheral flow directions are opposite and thereby result in an opposite sweep of the respective gaps 120, 122. That is, the degree of sweep is an angle into the adjacent flow.

Figure 7:
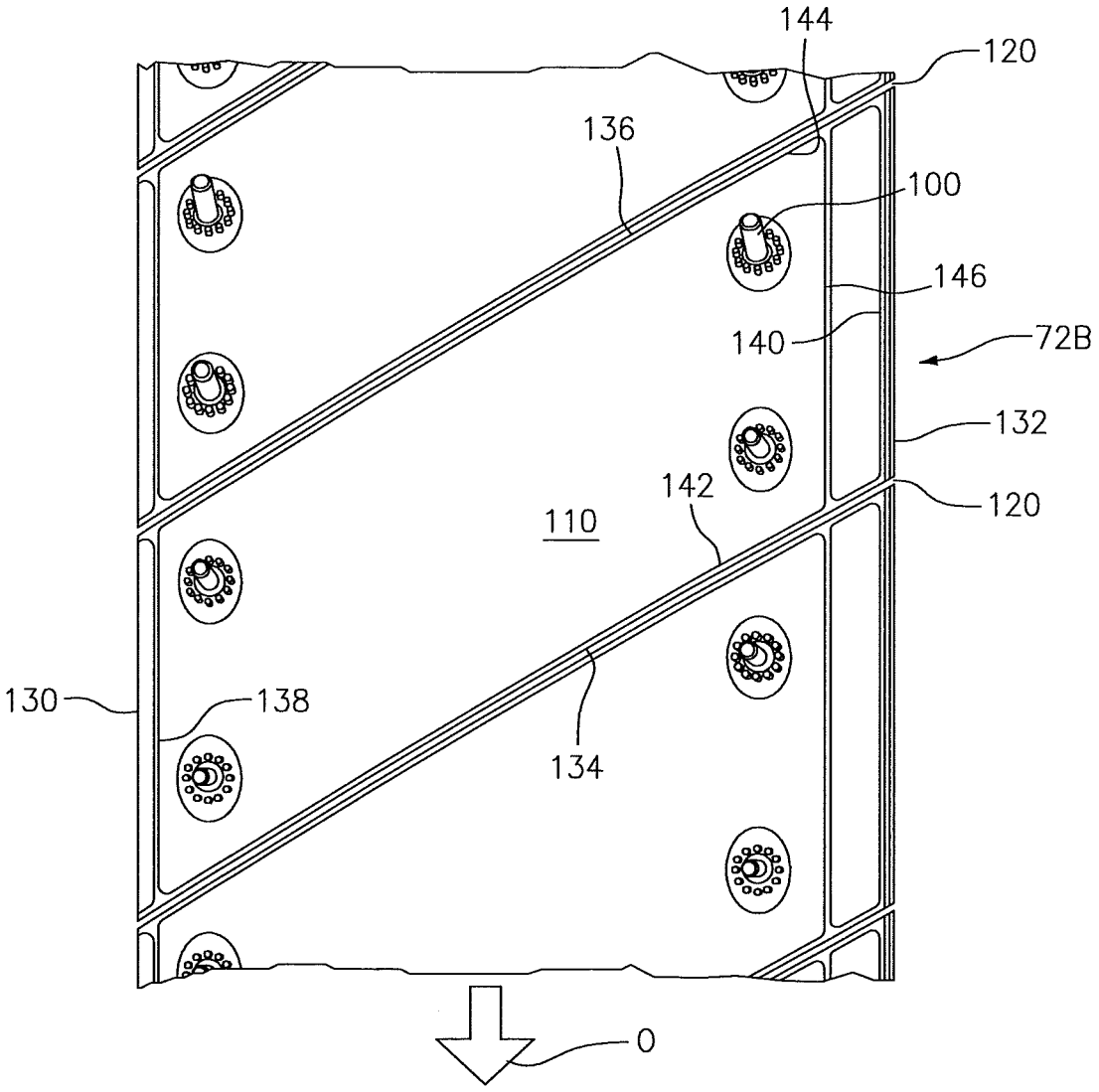
FIG. 7 is a cold side view of a swept liner panel according to another disclosed non-limiting embodiment.

With respect to FIG. 7, each liner panel 72B is generally a parallelogram in shape. Although aft outer liner panel 72B is illustrated and described in detail hereafter, it should be appreciated that the inner liner panel 74B as well as the forward liner panels 72A, 74A (see FIG. 3) will also benefit herefrom. The outer liner panel 72B generally includes a forward edge 130, an aft edge 132, a first liner panel side edge 134 and a second liner panel side edge 136. A rail 138, 140, 142, 144 extends from the cold side 110 adjacent to each respective edge 130, 132, 134, 136 to seal the periphery of the outer liner panel 72B to the respective support shell 68. It should be appreciated that various other rails such as an internal rail 146 may additionally be provided to form additional cavities.

The liner panel aft edge 132 is generally parallel to the liner panel forward edge 130. The first liner panel side edge 134 and the second liner panel side edge 136 extend between the liner panel aft edge 132 and the liner panel forward edge 130 and are generally parallel to each other. The first liner panel side edge 134 and the second liner panel side edge 136 are non-perpendicular to the liner panel forward edge 130 and the liner panel aft edge 132 to form the swept gap 120 between each of the multiple of liner panels 72B.

Figure 8:
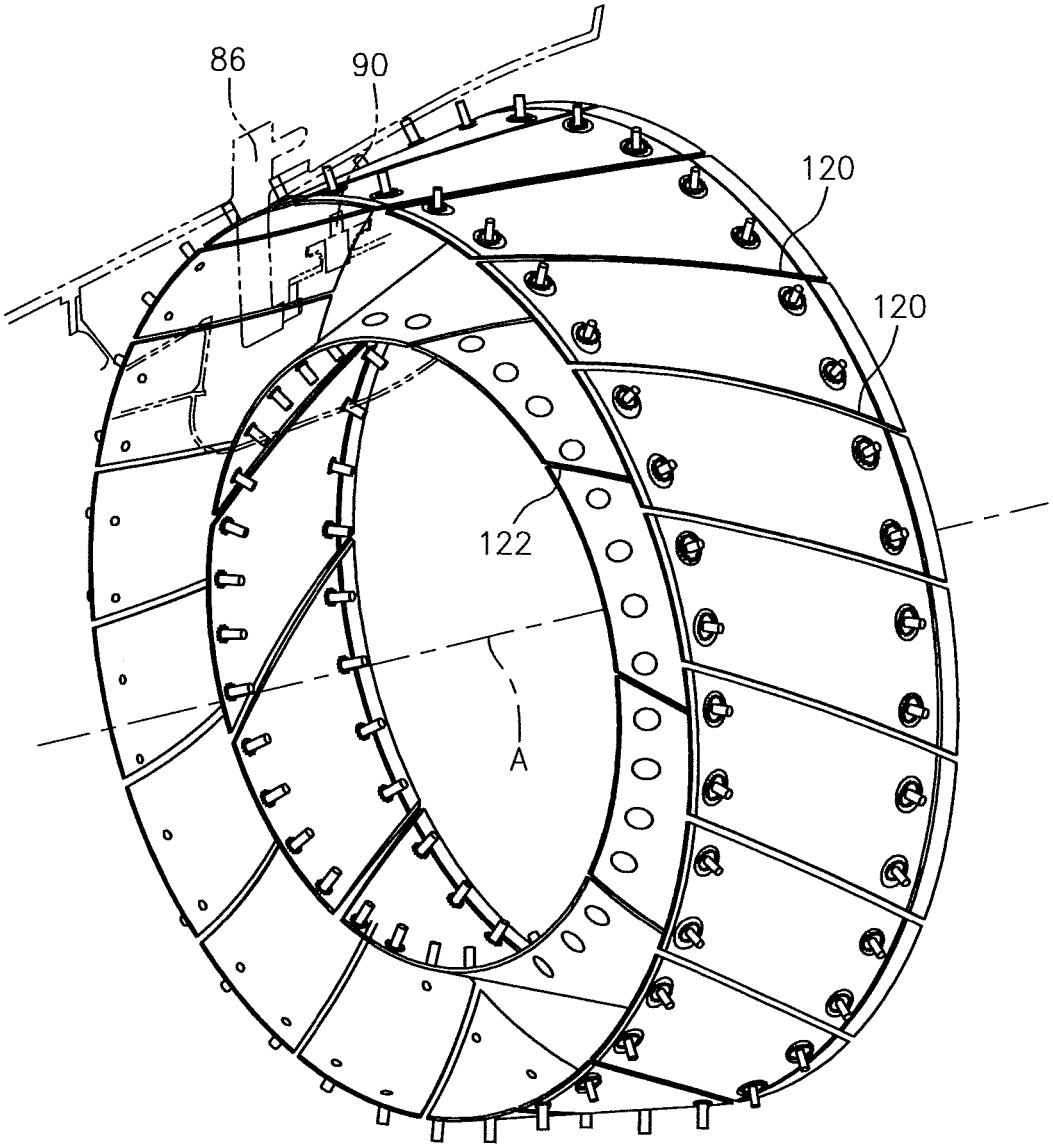
FIG. 8 is a perspective view of a combustor with swept liner panels according to another disclosed non-limiting embodiment.

With reference to FIG. 8, in yet another disclosed non-limiting embodiment, the gap 120, 122 between the adjacent respective liner panels 72, 74 are swept in the same direction such that the flow from the upstream swirlers 90 is with the respective liner panels 72 and against the respective liner panels 74. It should be appreciated that various sweep combinations for the liner panels 72, 74 may alternatively benefit herefrom.

The use of the terms "a" and "an" and "the" and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other. It should be appreciated that relative positional terms such as "forward," "aft," "upper," "lower," "above," "below," and the like are with reference to the normal operational attitude of the vehicle and should not be considered otherwise limiting.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

It should be appreciated that like reference numerals identify corresponding or similar elements throughout the several drawings. It should also be appreciated that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the features within. Various non-limiting embodiments are disclosed herein; however, one of ordinary skill in the art would recognize that various modifications and variations in light of the above teachings will fall within the scope of the appended claims. It is therefore to be appreciated that within the scope of the appended claims, the disclosure may be practiced other than as specifically described. For that reason the appended claims should be studied to determine true scope and content.

What is claimed:

1. A combustor of a gas turbine engine, the combustor comprising a wall assembly comprising:
   a support shell arranged around an engine central longitudinal axis; and
   a multiple of liner panels mounted to the support shell, the multiple of liner panels defining a multiple of liner panel gaps around the engine central longitudinal axis wherein each of the multiple of liner panel gaps is between circumferentially adjacent liner panels and each of the multiple of liner panels gaps are swept with respect to the engine central longitudinal axis;
   each of the multiple of liner panels comprising:
   a first liner panel side edge between a liner panel aft edge and a liner panel forward edge;
   a second liner panel side edge between the liner panel aft edge and the liner panel forward edge, the first and second liner panel side edges non-perpendicular to the liner panel forward and aft edge edges; and
   wherein the first liner panel side edge, the second liner panel side edge, the liner panel forward edge and the liner panel aft edge define a parallelogram;
   wherein the multiple of liner panels include outer liner panels inboard of an outer support shell with respect to the engine central longitudinal axis and the multiple of liner panels include inner liner panels outboard of an inner support shell with respect to the engine central longitudinal axis;
   wherein the multiple of liner panel gaps include a multiple of outer liner panel gaps and a multiple of inner liner panel gaps, the outer liner panel gaps swept in a direction opposite that of the multiple of inner liner panel gaps; and
   a multiple of swirlers configured to provide swirl flow;
   wherein the multiple of outer liner panel gaps and the multiple of inner liner panel gaps are swept transverse to a flow direction of the swirl flow.

2. The combustor as recited in claim 1, further comprising a multiple of studs which extend from each of the multiple of liner panels.

3. The combustor as recited in claim 2, wherein the first liner panel side edge and the second liner panel side edge of a first of the multiple of liner panels are parallel.

4. The combustor as recited in claim 3, wherein the liner panel forward edge and the liner panel aft edge of the first of the multiple of liner panels are parallel.

5. The combustor as recited in claim 1, wherein the liner panel forward edge and the liner panel aft edge of a first of the multiple of liner panels are parallel.

6. The combustor as recited in claim 4, wherein each of the multiple of outer and inner liner panel gaps are swept about 10-45 degrees with respect to the engine central longitudinal axis.

7. The combustor as recited in claim 4, wherein each of the multiple of outer and inner liner panel gaps are swept about 20 degrees with respect to the engine central longitudinal axis.

8. The combustor as recited in claim 1, wherein the flow direction of the swirl flow is transverse to the multiple of liner panel gaps.

* * * * *